US008040203B2

(12) United States Patent
Kawaguchi et al.

(10) Patent No.: US 8,040,203 B2
(45) Date of Patent: Oct. 18, 2011

(54) FILTER CIRCUIT AND RADIO COMMUNICATION DEVICE

(75) Inventors: Tamio Kawaguchi, Kanagawa (JP); Hiroyuki Kayano, Kanagawa (JP); Tatsunori Hashimoto, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 223 days.

(21) Appl. No.: 12/556,657

(22) Filed: Sep. 10, 2009

(65) Prior Publication Data

US 2010/0060378 A1 Mar. 11, 2010

(30) Foreign Application Priority Data

Sep. 11, 2008 (JP) ..... 2008-232859

(51) Int. Cl.
*H01P 1/213* (2006.01)
*H01B 12/02* (2006.01)

(52) U.S. Cl. ..... 333/99 S; 333/202

(58) Field of Classification Search ..... 333/99 S, 333/202, 176, 110, 126, 121, 132; 505/210
See application file for complete search history.

(56) References Cited

U.S. PATENT DOCUMENTS

| | | | | |
|---|---|---|---|---|
| 6,518,854 | B2 | 2/2003 | Kayano et al. | |
| 6,914,497 | B2 | 7/2005 | Sano et al. | |
| 7,492,239 | B1 * | 2/2009 | Sarkees | 333/124 |
| 2004/0041635 | A1 | 3/2004 | Sano et al. | |
| 2005/0285701 | A1 | 12/2005 | Kayano et al. | |
| 2007/0001787 | A1 | 1/2007 | Kayano | |
| 2008/0068113 | A1 | 3/2008 | Kayano | |
| 2008/0139142 | A1 | 6/2008 | Kayano et al. | |
| 2009/0128261 | A1 | 5/2009 | Kayano | |

FOREIGN PATENT DOCUMENTS

| | | |
|---|---|---|
| JP | 11-186812 | 7/1999 |
| JP | 11-330803 | 11/1999 |
| JP | 2001-345601 | 12/2001 |
| JP | 3380165 | 12/2002 |
| JP | 2004-96399 | 3/2004 |
| JP | 2008-147959 | 6/2008 |

OTHER PUBLICATIONS

Honjoh, et al. Synthesis of Microwave Circuits by Normal Mod Expansion—Synthesis of Rectangular Waveguide Filter with Dielectric Sheet Window. IEICE Technical Report. 1982. pp. 9-16.
Kato, et al. Studies on the equivalent circuits of dual-mode rectangular waveguide filters using HFSS and MDS. IEICE Technical Report. 1998. pp. 73-80.

* cited by examiner

*Primary Examiner* — Seungsook Ham
(74) *Attorney, Agent, or Firm* — Turocy & Watson, LLP

(57) ABSTRACT

The present invention provides a filter circuit that can achieve both sharp bandpass characteristics and high power handling capability. The filter circuit includes: an input terminal that has a signal input; a four-port device that divides input signals; a band stop filter that has the center frequency of the input signals within the stopband, and causes the out-of-stopband signals among the input signals to pass; two bandstop resonators circuits that cause the signals passing through the band stop filters to pass, and reflect the signals; open ends that are connected in parallel to the two bandstop resonators circuits; and an output terminal that outputs the signals reflected by the band stop filters and the bandstop resonators circuits and combined at the four-port device.

20 Claims, 11 Drawing Sheets

FILTER CIRCUIT AND RADIO COMMUNICATION DEVICE

CROSS-REFERENCE TO RELATED APPLICATION

This application is based upon and claims the benefit of priority from Japanese Patent Application No. 2008-232859, filed on Sep. 11, 2008, the entire contents of which are incorporated herein by reference.

FIELD OF THE INVENTION

The present invention relates to a filter circuit used in a radio communication device or the like, and a radio communication device including the filter circuit.

BACKGROUND OF THE INVENTION

Communication devices that perform wired or wireless information communications are formed with various high-frequency components such as amplifiers, mixers, and filters. Among those devices, bandpass filters (BPF) each have resonators arranged in a line, and allow only the signals of a particular frequency band to pass through the filters. To effectively use frequencies in today's communication systems, the filter characteristics should preferably be sharp shutoff characteristics, so that the available bandwidth can be used to a maximum extent. Further, in response to the demands for smaller communication devices, those filters should preferably be small in size.

To achieve desired filter characteristics, it is necessary to connect resonators to one another in an electromagnetic field. The circuit constant of the filter is formed with the resonant frequency $f_i$ of each resonator, the coupling coefficient $M_{ij}$, and the external quality factor Qe with the outside circuit.

FIG. 14 is an equivalent circuit of a conventional bandpass filter circuit. In FIG. 14, reference numeral 901 indicates input terminals, reference numeral 902 indicates output terminals, reference numerals 903(1) through 903(*n*) indicate resonators, and reference numerals 904(1) through 904(*n*−1) indicate coupling circuits. This filter circuit is formed with the resonators 903(1) through 903(*n*) cascade-connected as shown in FIG. 14. The equivalent circuit of each of the resonators shown in FIG. 14 is formed with an inductor L and a capacitor C, and a resistor is added to the equivalent circuit if a loss effect is taken into account. The resonant frequency of a resonator without a resistor is expressed by the following equation:

$$f_0=1/\mathrm{sqrt}(L*C)$$

where L and C represent the inductance and capacitance of the resonator.

In the filter circuit of FIG. 14, the resonators are cascade-connected, and the frequency pass range and the stopband attenuation of the filter circuit can be determined by appropriately deciding the coupling coefficient $M_{ij}$ ($m_{12}$, $m_{23}$, . . . , $m_{n-1,n}$ in FIG. 14) expressing the coupling amount of each of the resonators, and the value of the external quality factor (Qe in FIG. 14) expressing the coupling amount between the resonators and the input or output circuits.

Since a current flows to the respective resonators in a filter having the resonators connected in a cascaded circuit, all frequency components in the current flow into the resonators. Therefore, in the case of the resonators are made of a material having a current capacity, such as a superconductor, a power handling capability of each resonator is an important parameter for allowing large power to pass through the filter circuit. Studies are being made to develop a technique for improving the power handling capability by taking measures to prevent concentration of current flow on the resonator by application of circular disk-like resonators or wide transmission lines.

In a superconductive resonator made of a superconductor, however, the un-loaded Q value is extremely high, and therefore, the current concentration in the resonators becomes larger. As is apparent from this fact, high power capability is difficult to realize by changing the shapes of the resonators.

FIG. 15 is a equivalent circuit of another conventional filter circuit. As shown in FIG. 15, the resonators are connected to parallel circuit, which the input power is dispersed each resonator in the filter circuit, the resonators 913(1) through 913(*n*) are connected in parallel so as to form the filter circuit (as disclosed for example in JP-A-2001-345601 (KOKAI) and JP-A-2004-96399 (KOKAI)). By such a parallel circuit, inputted power is divided to each of resonator 913(1) to 913(*n*) so as to increase the power handling capacity as a whole.

To connect the resonators in parallel, the respective resonators are designed to have different resonant frequencies from one another ($f_1$, $f_2$, . . . , $f_n$ in FIG. 15), and combining the resonators such that the resonators with adjacent resonant frequencies have mutually reversed-phase, to realize the filter characteristics. In FIG. 15, the symbol "-" of "$-m_2$" indicates reversed-phase coupling. The structures of filter combining a superconductive filter and a normal conductive filter were disclosed for example in JP-3380165, JP-A-H11-186812 (KOKAI).

Although a superconductive filter and a normal conductive filter are connected in parallel in JP-3380165, the high power is inputted in both filters. When high power is supplied to the input, the power is divided and inputted into the filters, the divided power is separated only into power to be reflected in and power pass through each of filters, and with this shape, the superconductive filter also requires a high power handling capability. Furthermore, as a superconductive filter and a normal conductive filter are combined, the combined loss is increased, and it is impossible to take full advantage of the low loss effect of the superconductive component.

SUMMARY OF THE INVENTION

A filter circuit of a first aspect of the present invention includes: an input terminal for input a signal input having a certain band; a four-port device that receives the signal input from the input terminal at a terminal A, and divides and transmits the received signal through terminals B and C, and combines signals supplied to the terminals B and C, and transmits the combined signal through the terminal A if the signals are in-phase with each other and through a terminal D if the signals are reversed-phase with respect to each other; an output terminal that outputs the signal transmitted through the terminal D; a first band stop filter that has a center frequency of the input signal within the stopband, reflects the stopband signal and backs the signal to the terminal B, and passes a passband signal; a second band stop filter that has the same stopband as the first band stop filter, reflects the stopband signal and backs the signal to the terminal C, and passes a passband signal; a first bandstop resonators circuit that includes not less than one resonator to reflect signals of a desired band within the passband of the first band stop filter; a second bandstop resonators circuit that includes not less than one resonator having the same frequency as the first bandstop resonators circuit, to reflect signals of a desired band within the passband of the second band stop filter; a first open end that is connected in parallel to the first bandstop resonators circuit; and a second open end that is connected in parallel to the second bandstop resonators circuit, each signal reflected by the first band stop filter and supplied to the terminal B being in a reversed-phase with respect to each signal reflected by the second band stop filter and supplied to the terminal C, each signal reflected by the first bandstop resonators circuit and supplied to the terminal B being in a reversed-phase with respect to each signal reflected by the second bandstop resonators circuit and supplied to the terminal C, and each signal reflected by the first open end and supplied to the terminal B being in an in-phase with respect to each signal reflected by the second open end and supplied to the terminal C.

A filter circuit of a second aspect of the present invention includes: an input terminal for input a signal input having a certain band; a four-port device that receives the signal input from the input terminal at a terminal A and divides and transmits the received signal through terminals B and C, and combines signals supplied to the terminals B and C and transmits the combined signal through the terminal A if the signals are in-phase with each other and through a terminal D if the signals are reversed-phase with respect to each other; an output terminal that outputs the signal transmitted through the terminal D; a first band stop filter that has the center frequency of the input signal within the stopband, reflects the stopband signal at the first bandpass filter and backs the signal to the terminal B, and passes a passband signal; a second band stop filter that has the same stopband as the first band stop filter, reflects the stopband signal at the first bandpass filter and backs the signal to the terminal C, and passes a passband signal; a first bandstop resonators circuit that includes not less than one resonator to reflect a desired band in the passband through the first band stop filter; a second bandstop resonators circuit that includes not less than one resonator having the same frequency as the first bandstop resonators circuit, to reflect signals of a desired band within the passband of the second band stop filter; a first terminal end that is connected in parallel to the first bandstop resonators circuit; and a second terminal end that is connected in parallel to the second bandstop resonators circuit, each signal reflected by the first band stop filter and supplied to the terminal B being in a reversed-phase with respect to each signal reflected by the second band stop filter and supplied to the terminal C, and each signal reflected by the first bandstop resonators circuit and supplied to the terminal B being in a reversed-phase with respect to each signal reflected by the second bandstop resonators circuit and supplied to the terminal C.

A radio communication device of a third aspect of the present invention includes: a signal processing circuit that performs transmission processing on transmission data, to obtain a transmission signal; a power amplifier that amplifies the transmission signal; the filter circuit of one of the above embodiments that performs filtering on the amplified transmission signal; and an antenna that releases the signal obtained as a radiowave from the filter circuit to the air.

DETAILED DESCRIPTION OF THE EMBODIMENTS

The following is a description of embodiments of the present invention, with reference to the accompanying drawings.

First Embodiment

Figure 1:
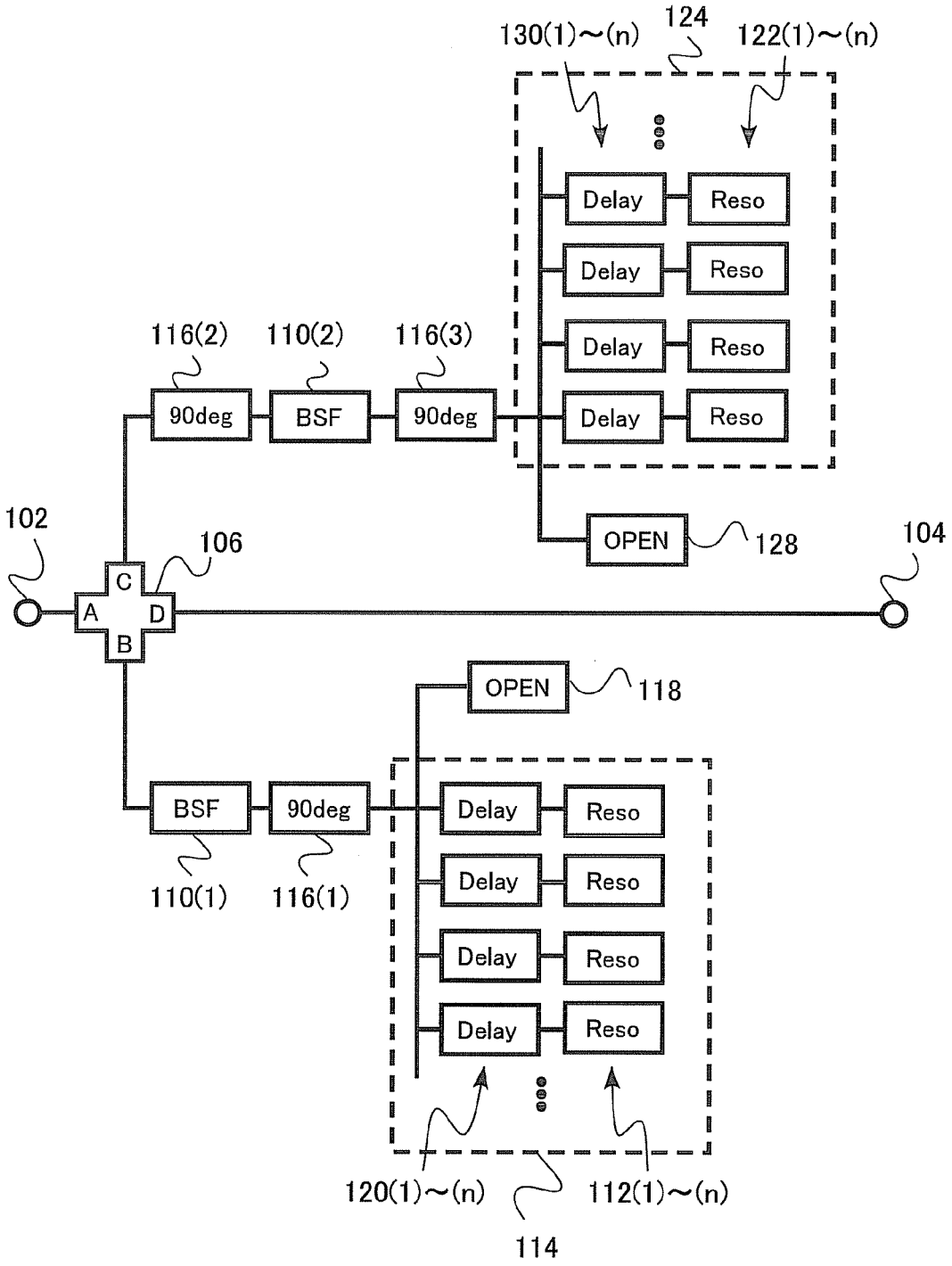
FIG. 1 is a block diagram schematically showing a filter circuit of a first embodiment.

FIG. 1 is a block diagram schematically showing a filter circuit of a first embodiment of the present invention.

As shown in FIG. 1, this filter circuit includes an input terminal 102. The filter circuit also includes a four-port device 106 that receives each signal input from the input terminal 102 at a terminal A, divides the received signal and transmits the divided signal through a terminal B and a terminal C, combines signals to be supplied to the terminal B and the terminal C, and transmits the signals through the terminal A if the signals are in-phase or through a terminal D if the signals are reversed-phase with respect to each other. The filter circuit also includes an output terminal 104 that outputs the signals transmitted through the terminal D of the four-port device 106.

This filter circuit further includes a first band stop filter (BSF) 110(1) that has the center frequency of each signal input from the input terminal 102 within a stopband, and reflect the signals within the stopband among the signals transmitted from the terminal B of the four-port device 106 back to the terminal B, and let the signals outside the stopband pass through. The filter circuit also includes a second band stop filter 110(2) that has the same stopband as the stopband of the first band stop filter 110(1), and reflect the signals within the stopband among the signals transmitted from the terminal C of the four-port device 106 back to the terminal C, and let the signals outside the stopband pass.

The filter circuit further includes a first bandstop resonators circuit 114 that reflects signals of a desired band among the signals passing through the first band stop filter 110(1) with the use of first resonators 112(1) through 112(*n*) (n being a positive integer). The filter circuit also includes a second bandstop resonators circuit 124 that reflects signals of a desired band among the signals passing through the second band stop filter 110(2) with the use of second resonators

122(1) through 122(*n*) having the same frequency as the first resonators 112(1) through 112(*n*).

The filter circuit further includes a first open end 118 connected in parallel to the first bandstop resonators circuit 114, and a second open end 128 connected in parallel to the second bandstop resonators circuit 124.

A first 90-degree delay circuit 116(1) is provided between the first band stop filter 110(1) and the first bandstop resonators circuit 114. A second 90-degree delay circuit 116(2) is provided between the terminal C of the four-port device 106 and the second band stop filter 110(2). A third 90-degree delay circuit 116(3) is provided between the second band stop filter 110(2) and the second bandstop resonators circuit 124.

The filter circuit is designed so that the signals reflected by the first band stop filter 110(1) and supplied to the terminal B of the four-port device 106 are in the reversed-phase relationship (its means 180-degree difference) with respect to the signals reflected by the second band stop filter 110(2) and supplied to the terminal C of the four-port device 106. The filter circuit is also designed so that the signals passing through and reflected by the first bandstop resonators circuit 114 and supplied to the terminal B are in the reversed-phase relationship with respect to the signals passing through and reflected by the second bandstop resonators circuit 124 and supplied to the terminal C. The filter circuit is also designed so that the signals reflected by the first open end 118 and supplied to the terminal B of the four-port device 106 are in-phase (its means 0-degree difference) with the signals reflected by the second open end 128 and supplied to the terminal C of the four-port device 106.

Having the above structure, the filter circuit of this embodiment uses the four-port device to divide signals of a frequency range in the vicinity of the center frequency receiving large power, into two channels: a first channel and a second channel. Each high-power signals reflected by the band stop filter located on the divided two channels is transmitted through a path that does not pass through the bandstop resonators circuits.

Meanwhile, the bandstop resonators circuits located on the divided two channels transmit only the power of smaller signal strength than the center band, and combine the signals reflected by the bandstop resonators circuits and the signals reflected by the band stop filters. The out-of-band signals that do not pass through the bandstop resonators circuits are returned to the input terminal side.

With this structure, it is possible to protect a resonator of the bandstop resonator circuits that has low loss filter performance but has poor power resistance characteristics, such as superconductive resonators. Accordingly, it is possible to provide a filter circuit that has both sharp bandpass characteristics and excellent power resistance.

In the filter circuit shown in FIG. 1, the terminals A through D of the four-port device 106 is defined as a device that has four terminals with the S parameters defined by the following equation:

$$[S] = \frac{1}{\sqrt{2}}\begin{bmatrix} 0 & 0 & 1 & 1 \\ 0 & 0 & -1 & 1 \\ 1 & -1 & 0 & 0 \\ 1 & 1 & 0 & 0 \end{bmatrix}$$

Figure 2:
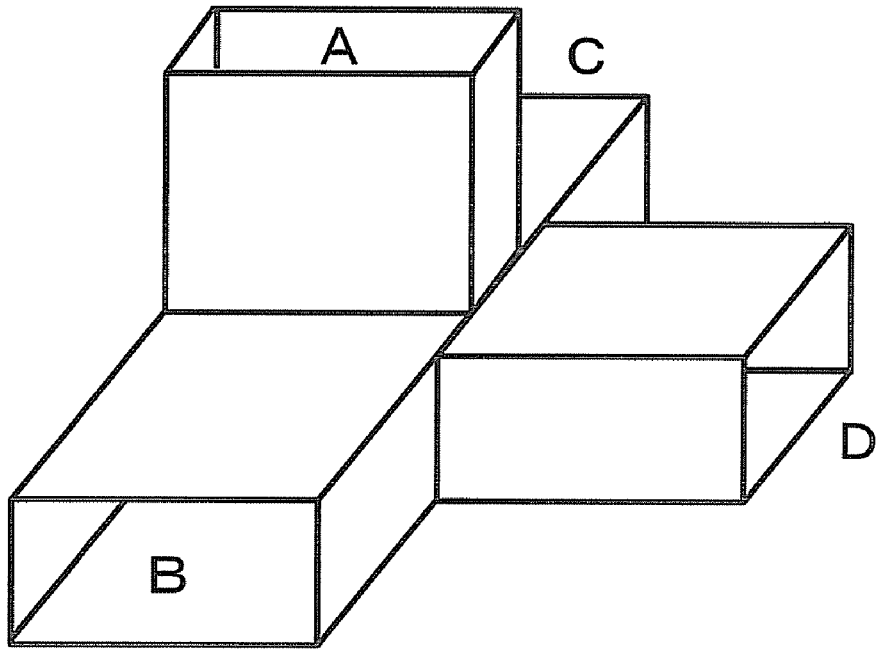
FIG. 2 shows a specific example of the four-port device.
Figure 3:
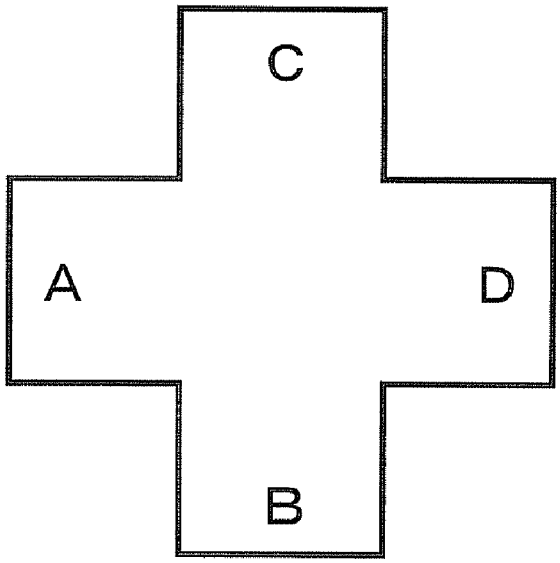
FIG. 3 shows the terminal number of the four-port device.
Figure 4:
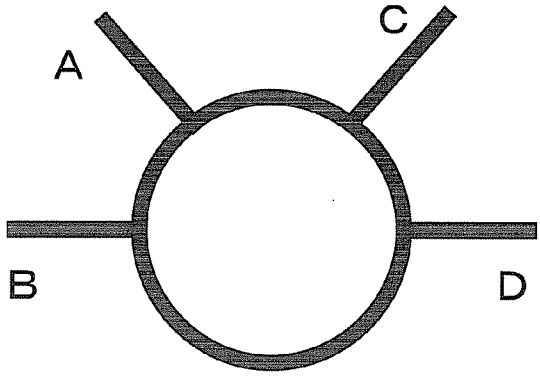
FIG. 4 shows another specific example of the four-port device.

The four-port device 106 may be a magic T that uses waveguides as shown in FIG. 2, for example. The respective terminals are located as shown in FIG. 3. Since the frequency band to be matched is wide, it is preferable that the four-port device 106 is formed with a magic T. However, the four-port device 106 is not limited to a magic T, but may be formed with a rat race circuit that uses transmission lines as shown in FIG. 4, for example.

The first and second bandstop resonators circuits 114 and 124 are blocks formed with bandstop resonators having different frequencies, and the same blocks are located on the first channel and the second channel. The bandstop resonators circuits 114 and 124 are formed with bandstop resonators 112(1) through 112(*n*) and 122(1) through 122(*n*) that have a power resistance of $W_{reso}$ (W) or less and 2 to N (N being a positive integer) different resonant frequencies $f_{reso-i}$ (i being integers ranging from 2 to N) and are cascade-connected to delay circuits 120(1) through 120(*n*) and 130(1) through 130(*n*). The delay circuits 120(1) through 120(*n*) and 130(1) through 130(*n*) are designed to satisfy the phase difference condition that the signals to be reflected by two bandstop resonators having adjacent resonant frequencies fall within a range of 180+360×k±30 degrees (k being an integer of 0 or greater).

In the first bandstop resonators circuit 114 in FIG. 1, for example, the delay circuits 120(1) through 120(*n*) are connected to all the bandstop resonators 112(1) through 112(*n*). However, the above phase difference condition may be satisfied by providing a 90-degree delay circuit to only one of each two bandstop resonators having adjacent resonant frequencies, for example.

The power resistance $W_{reso}$ (W) of each of the bandstop resonators constituting the first and second bandstop resonators circuits 114 and 124 satisfies the relationship, $W_{bsf} > W_{reso}$, with $W_{bsf}$ (W) being the power resistance of the first band stop filter 110(1) and the second band stop filter 110(2). The relationship between the resonant frequency $f_{reso-i}$ of each of the bandstop resonators and two resonant frequencies $f_{bsf1}$ and $f_{bsf2}$ ($f_{bsf1} < f_{bsf2}$) defining the bandwidth of the reflection characteristics of the band stop filters is expressed as $f_{reso-i} < f_{bsf1}$ or $f_{bsf2} < f_{reso-i}$. In other words, each of the bandstop resonators has its resonant frequency outside the stopbands of the band stop filters. Using those bandstop resonators, the resonators circuits 114 and 124 extract the signals of the desired band from the signals outside the stopbands of the band stop filters 110(1) and 110(2), and contribute to the sharp bandpass characteristics of the filter circuit.

The 90-degree delay circuit 116(2) is provided so that the phase difference between the electric length from the terminal C of the four-port device 106 to the second band stop filter 110(2) and the electric length from the terminal B of the four-port device 106 to the first band stop filter 110(1) is 90 degrees. With this arrangement, each signal reflected by the first band stop filter 110(1) is in the reversed-phase relationship with respect to each signal reflected by the second band stop filter 110(2). Accordingly, each of the signals is transmitted from the terminal D of the four-port device (106) to the output terminal 104.

The 90-degree delay circuit 116(1) is provided between the first band stop filter 110(1) and the first bandstop resonators circuit 114, and the 90-degree delay circuit 116(3) is provided between the second band stop filter 110(2) and the second bandstop resonators circuit 124. With this arrangement, each signal that is reflected by the first bandstop resonators circuit 114 and is input to the terminal B of the four-port device 106 is in the reversed-phase relationship with respect to each signal that is reflected by the second bandstop resonators circuit 124 and is input to the terminal C of the four-port device 106. Accordingly, each of the signals is transmitted from the terminal D of the four-port device 106 to the output terminal 104.

The filter circuit of this embodiment also includes the first open end 118 connected in parallel to the first bandstop resonators circuit 114, and the second open end 128 connected in parallel to the second bandstop resonators circuit 124, as described above. The open ends 118 and 128 reflect the signals of the bands that have not passed through the first and second bandstop resonators circuits 114 and 124, or the signals not to be transmitted through the filter circuit. This filter circuit is designed so that each signal that is reflected by the first open end 118 and is supplied to the terminal B of the four-port device 106 is in-phase as each signal that is reflected by the second open end 128 and is supplied to the terminal C of the four-port device 106. Accordingly, those signals are transmitted from the terminal A of the four-port device 106 to the input terminal 102. Thus, those signals are to be output from the output terminal 104.

With this structure, a filter circuit can be formed with filters having lower power resistance than the band stop filters 110(1) and 110(2), without a decrease in the power resistance of the filter circuit. In a case where high electric power is to pass through a bandpass filter made of a superconducting material having a limited current value, for example, a conventional filter structure cannot allow high power to pass through, since the critical current value is exceeded.

The filter circuit of FIG. 1 has the advantage that signals with high signal power do not need to be transmitted through a superconductive filter, and the filter can still be formed, if the signals have high power density within the stopbands of the band stop filters 110(1) and 110(2). With this structure, a filter having high power resistance and sharp skirt characteristics can be formed.

In a case where the resonators in the bandstop resonators circuits are superconductive resonators that require cooling, for example, the cables connecting the superconductors in the cooling device to external circuits is halved by the bandstop resonators, compared with the cables required by bandpass resonators. Accordingly, the heat flow rate can be lowered, and a smaller filter circuit can be formed. Further, the number of devices such as delay circuits and four-port devices can be reduced, compared with the number of devices in a case where bandpass resonators are used.

Figure 5A:
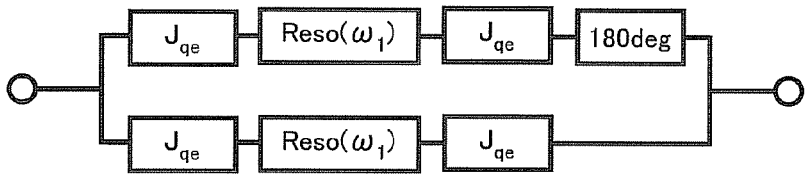
FIGS. 5A and 5B illustrate the principles of the filter circuit.
Figure 5B:
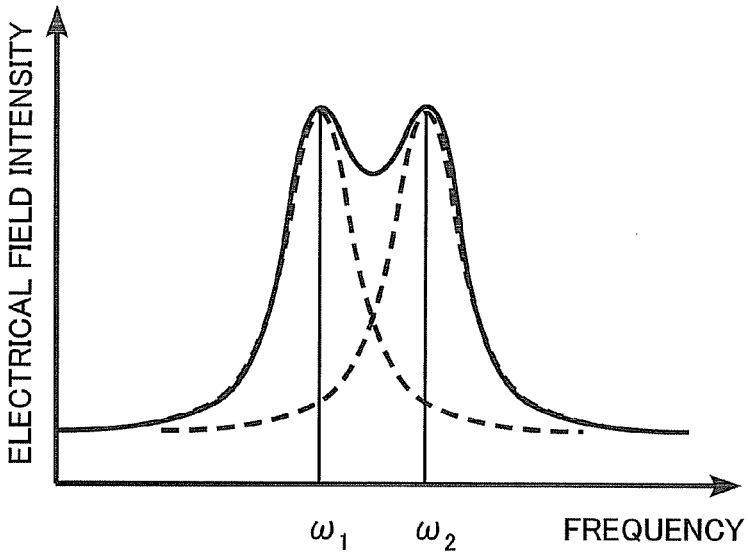
Figure 6A:
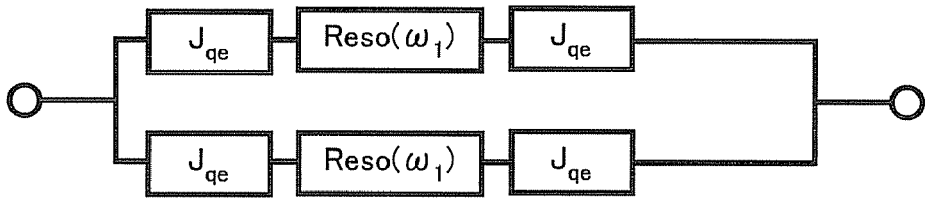
FIGS. 6A and 6B illustrate the principles of the filter circuit.
Figure 6B:
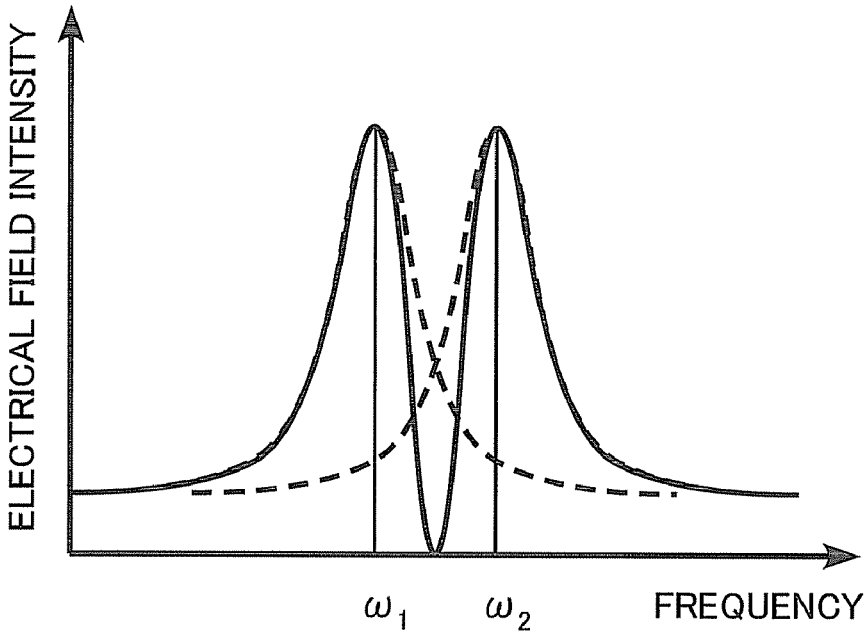

FIGS. 5A and 5B and FIGS. 6A and 6B illustrate the principles of operations of filter circuits formed with parallel-connected resonators. As shown in FIGS. 5A and 5B, the output obtained by combining two resonance waveforms of frequencies $\omega_1$ and $\omega_2$ with a 180-degree delay difference is the summation synthesis of the two resonance waveforms, and a bandpass filter can be formed by adjusting the combined value. As shown in FIGS. 6A and 6B, difference synthesis is achieved, if the two resonance waveforms are combined with the delay difference being 0.

Figure 7:
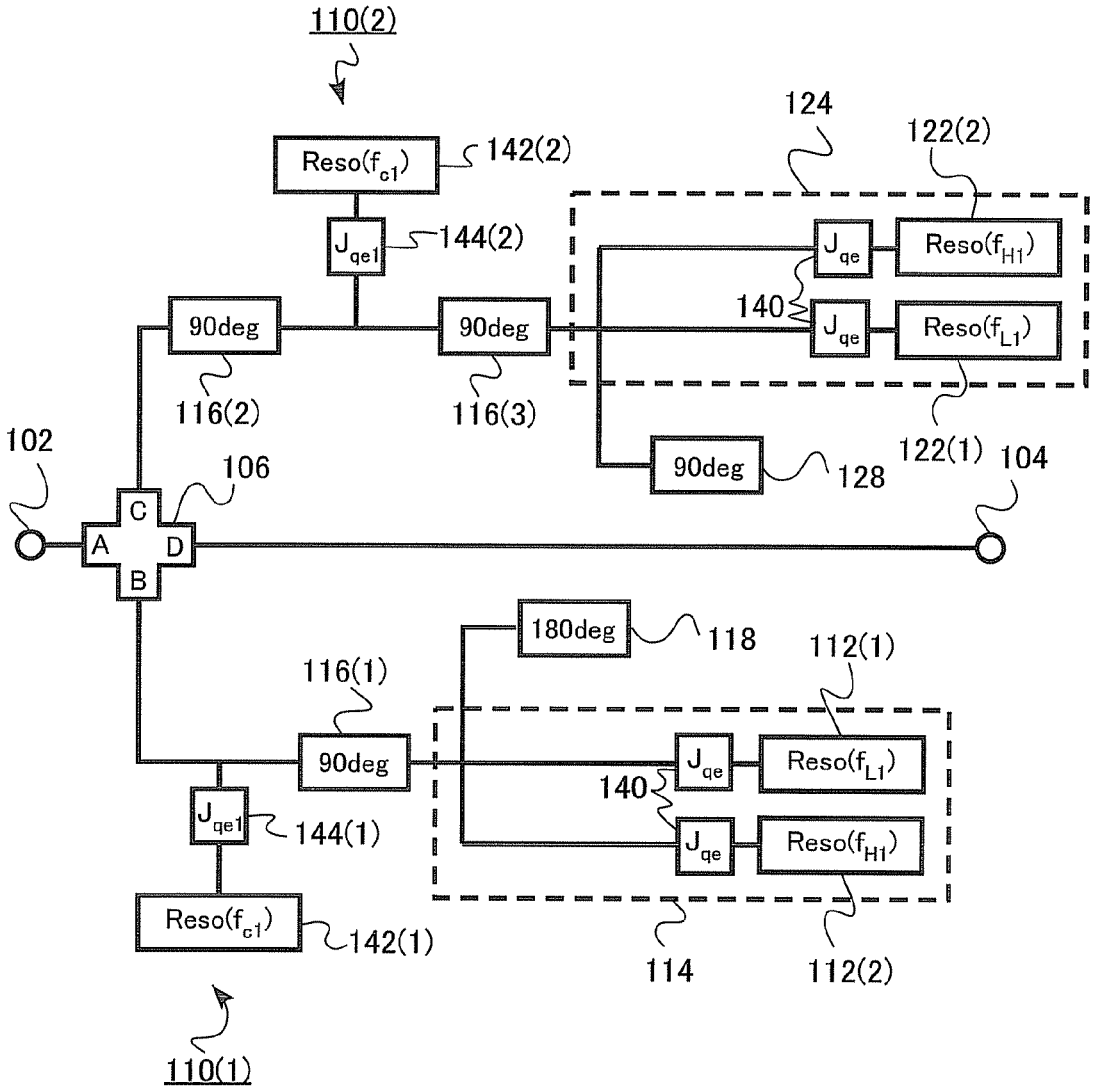
FIG. 7 is a circuit diagram of the filter circuit of the first embodiment.

FIG. 7 is a circuit diagram showing the specific structure of the filter circuit of FIG. 1. In this specific structure, n is 2.

The bandstop resonators circuits 114 and 124 parallel-connect the resonators 112(1) and 122(1) having a lower-band resonant frequency $f_{L1}$, the resonators 112(2) and 122(2) having a higher-band resonant frequency $f_{H1}$, and coupling circuits 140 having Qe as the external Q of each resonator, with the use of power distribution and synthesis circuits.

The first open end 118 having an electric length of 180 degrees with respect to the center frequency of the desired band, and the second open end 128 having an electric length of 90 degrees with respect to the center frequency of the desired band are also provided in parallel with the bandstop resonators circuits 114 and 124. Accordingly, the electric lengths of the two open ends with respect to the center frequency of the desired band differ from each other by 90 degrees.

By virtue of the first and second open ends 118 and 128, the phase difference between unnecessary signals that do not pass through the bandstop resonators circuits 114 and 124 is 180 degrees on the first channel and the second channel, and are combined in phase at the four-port device 106. Thus, those unnecessary signals are not output from the output terminal 104.

The bandstop resonators circuits 114 and 124, and the open ends 118 and 128 may be formed with transmission lines of conductive materials formed on an insulating substrate. For example, an earth conductor may be provided on one face of the insulating substrate, and a line conductor to be the transmission lines may be provided on the other face. Examples of the conductive materials include metals such as copper and gold, superconductive materials such as niobium and niobium tin, and Y-based copper oxide high-temperature superconductors. The substrate may be made of magnesium oxide, sapphire, lanthanum aluminate, or the like.

For example, superconductive microstrip lines are formed as transmission lines on a magnesium oxide substrate of approximately 0.43 mm in thickness and approximately 10 in relative permittivity. In this case, the superconductive material of the microstrip lines is a Y-based copper oxide high-temperature superconductive thin film of approximately 500 nm in thickness, and the line width of each strip conductor is 0.4 mm, for example. Also, to obtain high-quality Y-based copper oxide superconductive film, a buffer layer may be provided between the substrate and the superconductive film.

The buffer layer may be a $CeO_2$ layer, a YSZ layer, or the like. The superconductive thin film may be formed by a laser vapor deposition technique, a sputtering technique, a thermal co-evaporation technique, the MOD technique, or the like. The filter structure may be formed with other kinds of lines such as strip lines or coplanar lines, instead of microstrip lines. Furthermore, the filter may be formed with other various resonators such as dielectric resonators or cavity resonators, instead of the above described resonators.

The band stop filters 110(1) and 110(2) are formed with resonators 142(1) and 142(2) having a resonant frequency $f_{c1}$, and coupling circuits 144(1) and 144(2) having Qbsf as the external Q. Since high power resistance is required, dielectric resonators or cavity resonators can be used, for example.

Figure 8A:
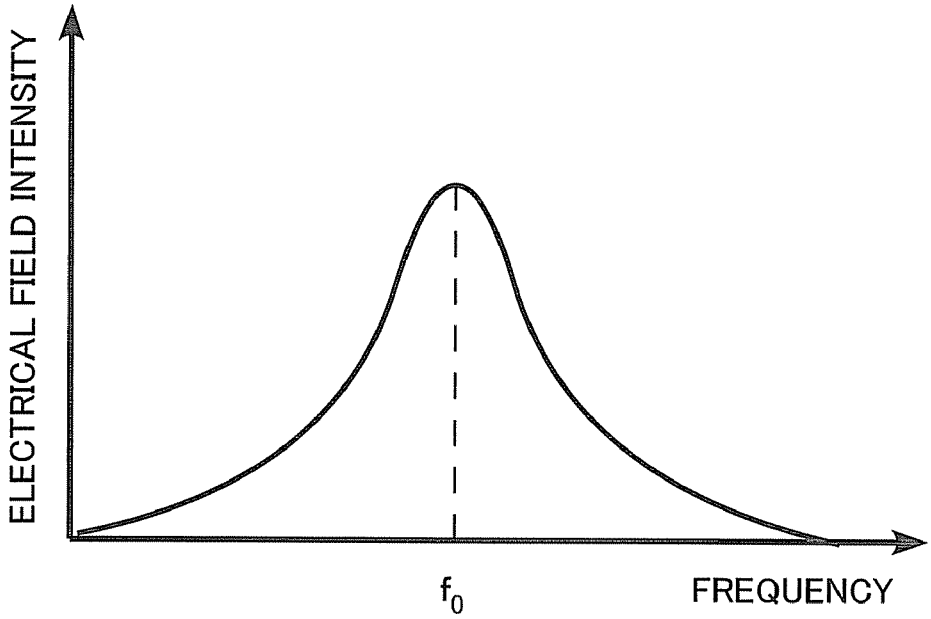
FIGS. 8A and 8B show the circuit characteristics of the filter circuit of the first embodiment.
Figure 8B:
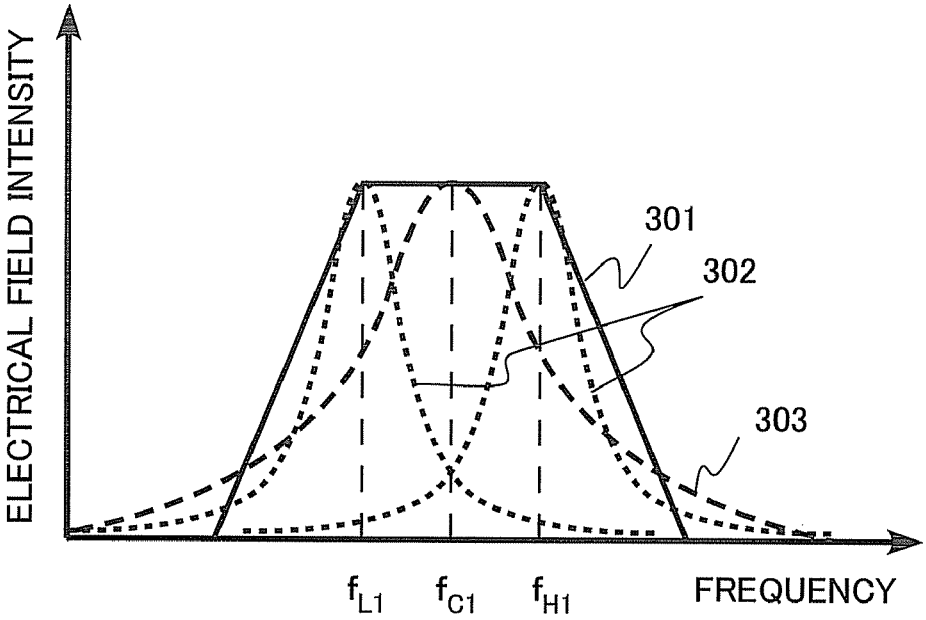

FIGS. 8A and 8B illustrate the circuit characteristics of the filter circuit of the first embodiment. FIG. 8A shows an example of the spectrum of a signal input to this filter circuit. FIG. 8B shows the frequency response of the filter circuit. In FIG. 8B, reference numeral 301 indicates the filter characteristics, reference numeral 302 indicates the resonance waveform, and reference numeral 303 indicates the input signal.

The signal that is input from the input terminal 102 of the filter circuit of FIG. 7 has its power divided into two at the first four-port device 106, and is output through the terminals B and C.

The power in the vicinity of the center frequency $f_{c1}$ is reflected by the band stop filters 110(1) and 110(2) formed with the resonators 142(1) and 142(2) for band stop filters and the coupling circuits 144(1) and 144(2). The signals reflected by the band stop filters 110(1) and 110(2) have a 180-degree phase difference with each other due to the existence of the delay circuit 116(2), and are returned to the terminals B and C of the four-port device 106, being in a reversed-phase relationship with each other. The signals are then combined in power, and are output through the terminal D of the four-port device 106.

Meanwhile, the signals of the frequency bands that pass through the band stop filters are reflected by synthetic waves formed by adding the resonance waveforms at the bandstop resonators circuits 114 and 124.

Due to the existence of the delay circuits 116(1) through 116(3), those signals are also returned to the terminals B and C of the four-port device 106, being in a reversed-phase relationship with each other. The signals are then combined in power, and are output through the terminal D of the four-port device 106.

The signals that do not pass through the bandstop resonators circuits 114 and 124 are caused to have a phase difference of 180 degrees and are reflected by the first and second open ends 118 and 128. Lastly, those signals are returned to the terminals B and C of the four-port device 106, being in an in-phase relationship with respect to each other. Accordingly, those signals are combined in power, output through the terminal A of the four-port device 106, and are returned to the input terminal 102.

In this manner, high power in the vicinity of the center frequency fc of the desired band of the filter does not pass through the bandstop resonators circuits 114 and 124 in the later stage, and signals of unnecessary bands are returned to the input terminal. Accordingly, it becomes possible to achieve both sharp filter characteristics with the use of a superconductive material, and high power resistance characteristics.

Figure 9:
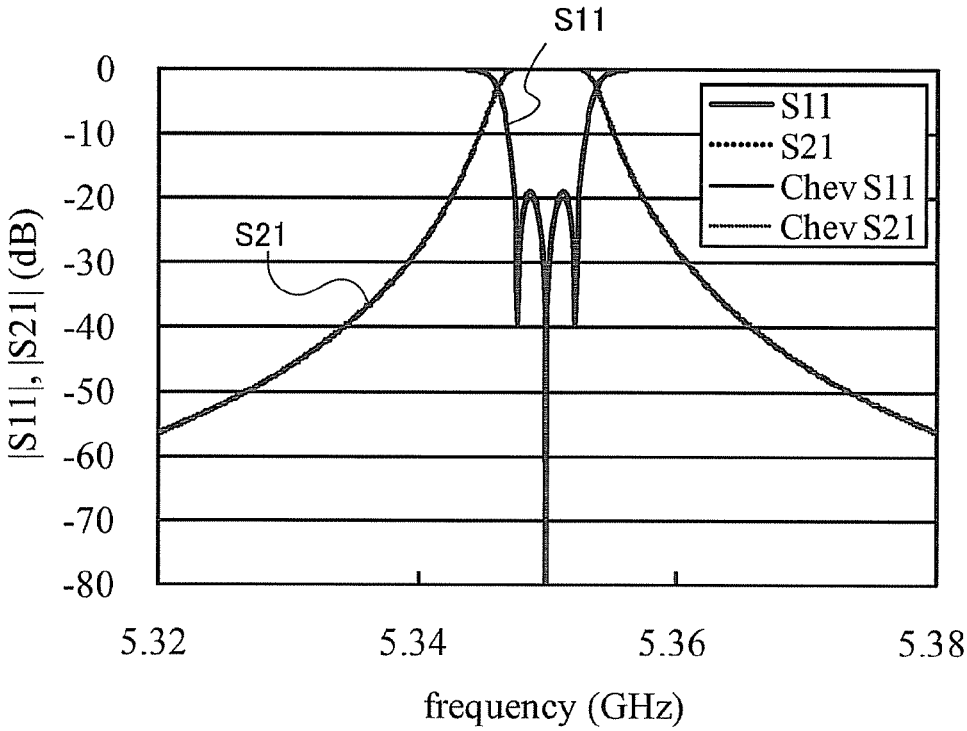
FIG. 9 shows the results of a simulation performed to check the frequency characteristics of the filter circuit of the first embodiment.

FIG. 9 shows the results of a simulation performed to check the frequency characteristics of the filter of FIG. 7. As shown in FIG. 9, the center frequency of the filter is 5.35 GHz, and desired Chebychev characteristics are achieved.

Figure 10:
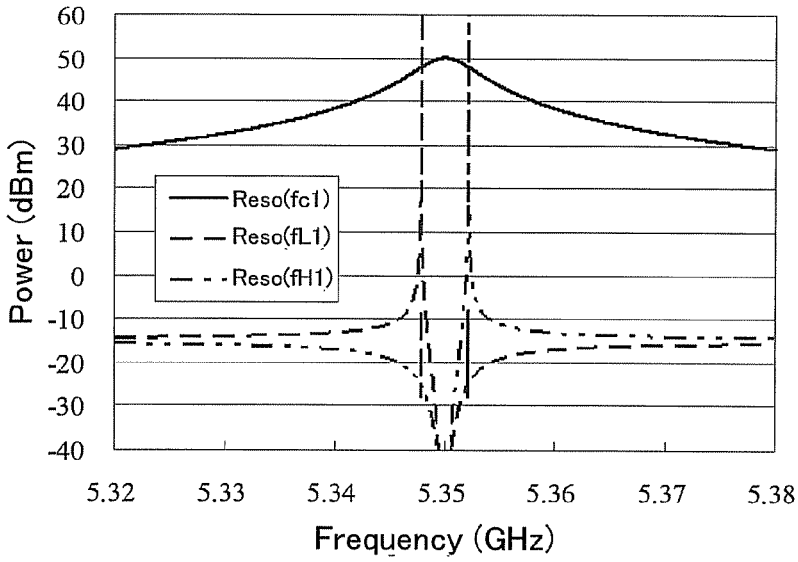
FIG. 10 shows the results of a simulation performed to check the frequency characteristics of the power peak of the filter circuit of the first embodiment.

FIG. 10 shows the results of a simulation performed to check the frequency characteristics of the peak of the power flowing in each of the bandstop resonators of the filter shown in FIG. 7. Calculations were performed where a power of 50 dBm in CW (Continue Wave) was applied to the filter. As can be seen from FIG. 10, when a signal having a power peak at the center is input, most power flows in the band stop filters (Reso (fc1)), and no power enters the bandstop resonators circuits (Reso (fL1), Reso(fH1)) in the later stage.

Second Embodiment

A filter circuit of a second embodiment of the present invention is the same as the filter circuit of the first embodiment, except that the open ends are replaced with terminal ends. Therefore, explanation of the same aspects as those of the first embodiment is omitted herein.

Figure 11:
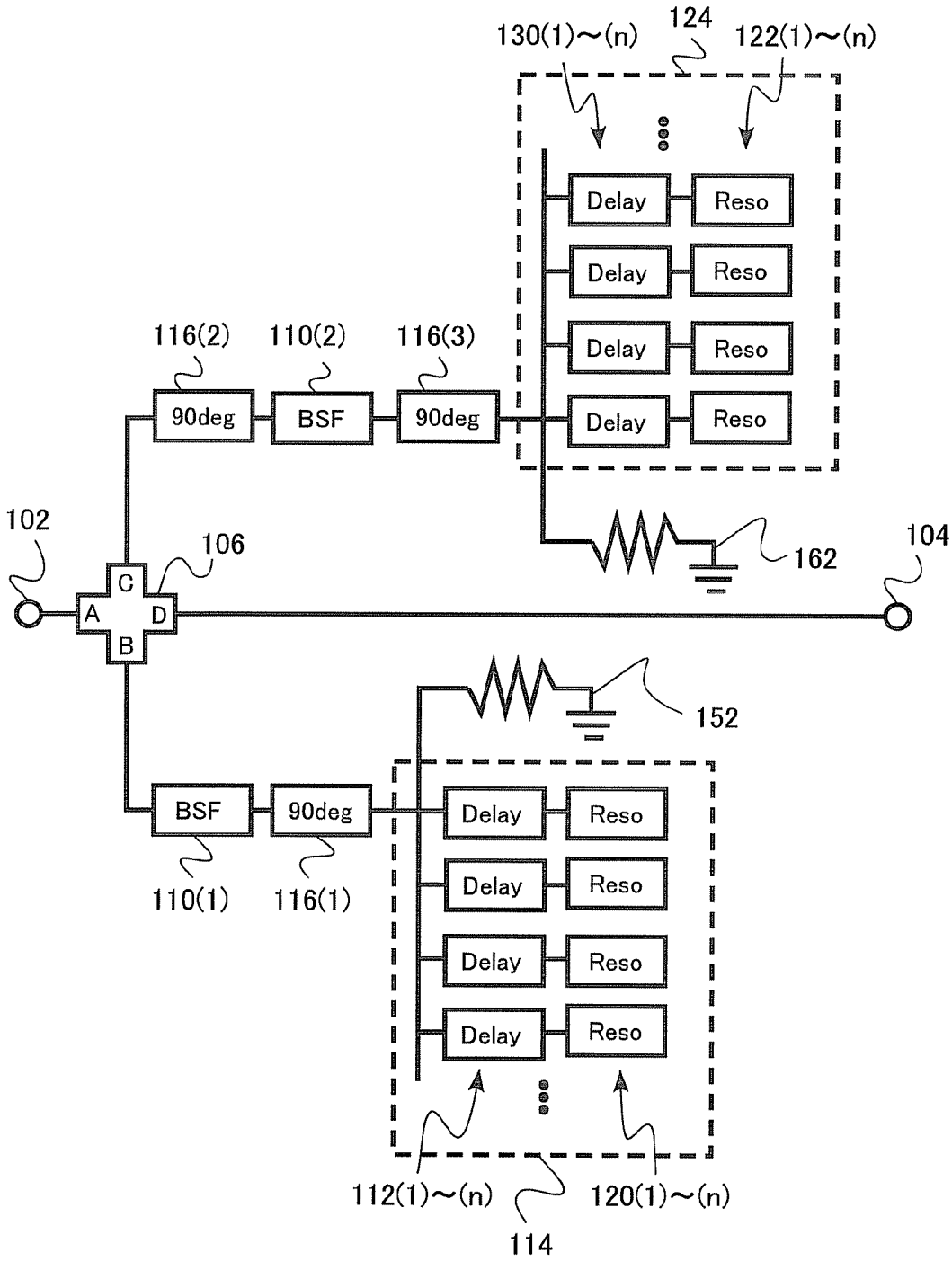
FIG. 11 is a block diagram schematically showing a filter circuit of a second embodiment.

FIG. 11 is a block diagram schematically showing the filter circuit of this embodiment. As shown in FIG. 11, this filter circuit has a first terminal end 152 connected in parallel to the first bandstop resonators circuit 114, and a second terminal end 162 connected in parallel to the second bandstop resonators circuit 124.

By virtue of the terminal ends 152 and 162, signals that are not reflected by the band stop filters 110(1) and 110(2) and the bandstop resonators circuits 114 and 124 can be short-circuited, and are not output to the output terminal 104.

The terminal ends 152 and 162 may be formed with terminators, ground lines, resistors, or the likes.

By replacing the open ends with the terminal ends, it becomes possible to completely absorb unnecessary signals.

Third Embodiment

A filter circuit of a third embodiment of the present invention is the same as the filter circuit of the first embodiment, except that a phase shifter is provided between the first band stop filter and the first bandstop resonators circuit or between the second band stop filter and the second bandstop resonators circuit. Therefore, explanation of the same aspects as those of the first embodiment is omitted herein.

Figure 12:
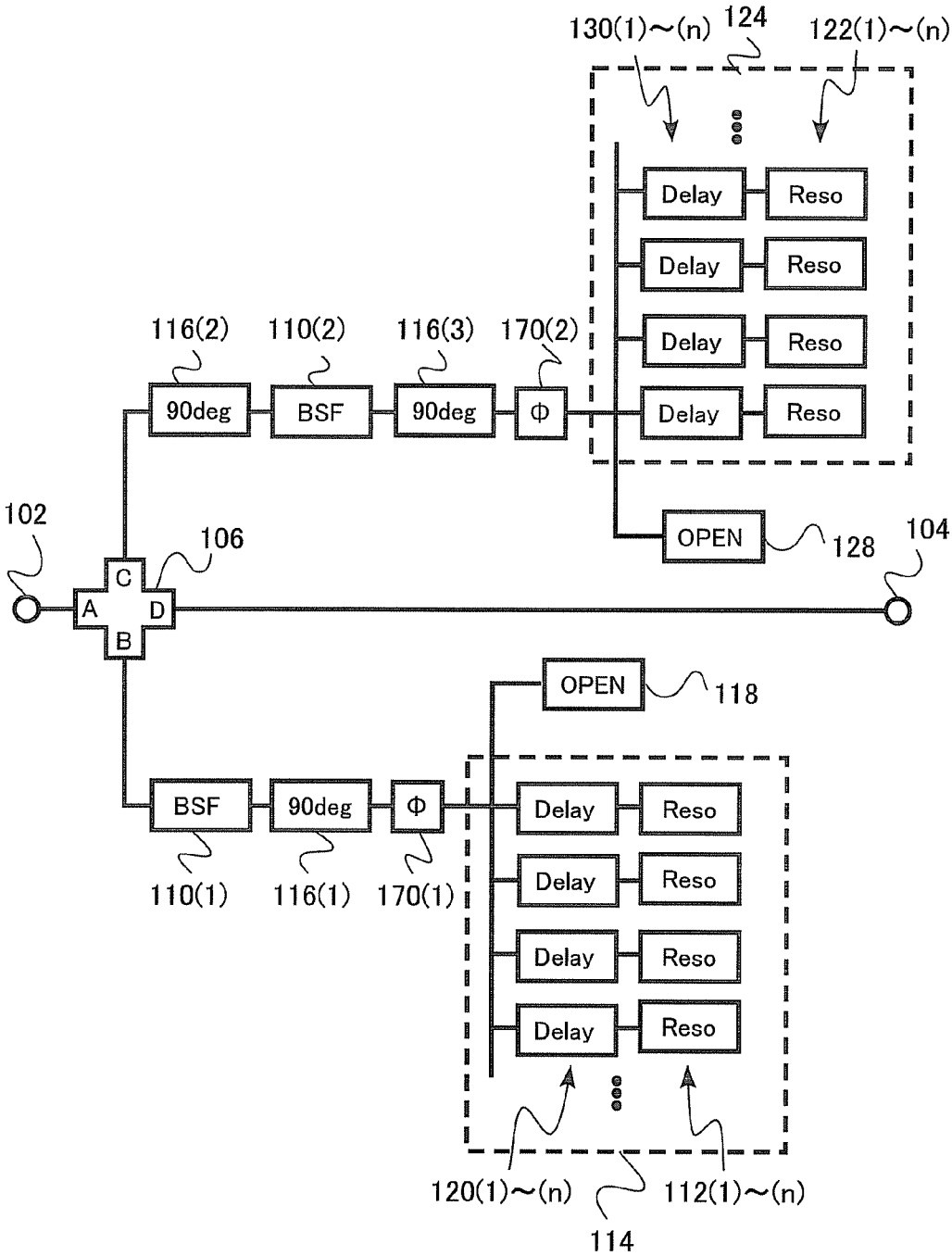
FIG. 12 is a block diagram schematically showing a filter circuit of a third embodiment.

FIG. 12 is a block diagram schematically showing the filter circuit of this embodiment. As shown in FIG. 12, this filter circuit has a first phase shifter 170(1) for phase adjustment between the first band stop filter 110(1) and the first bandstop resonators circuit 114, and a second phase shifter 170(2) for phase adjustment between the second band stop filter 110(2) and the second bandstop resonators circuit 124.

In the filter circuit described in the first embodiment, signals distributed from the four-port device 106 are reflected by the respective components of the circuit, and a desired filtering function is realized by controlling the phase relationship among those signals. More specifically, the phase relationship is controlled so that each signal reflected by the first band stop filter 110(1) and supplied to the terminal B of the four-port device 106 is in a reversed phase relationship with respect to each signal reflected by the second band stop filter 110(2) and supplied to the terminal C, each signal reflected by the first bandstop resonators circuit 114 and supplied to the terminal B is in a reversed phase relationship with respect to each signal reflected by the second bandstop resonators circuit 124 and supplied to the terminal C, and each signal reflected by the first open end 118 and supplied to the terminal B is in an in-phase relationship with respect to each signal reflected by the second open end 128 and supplied to the terminal C. Therefore, it is important to appropriately control the phase relationships among those signals.

In this embodiment, it is possible to achieve desired filter characteristics by adjusting the phase of the signal on each channel with the use of the phase shifters 170(1) and 170(2). Although FIG. 12 shows an example case where a phase shifter is provided on both the first and second channels branching from the four-port device 106, it is possible to adjust the phase relationships by providing a phase shifter only on one of the channels, for example.

Fourth Embodiment

Figure 13:
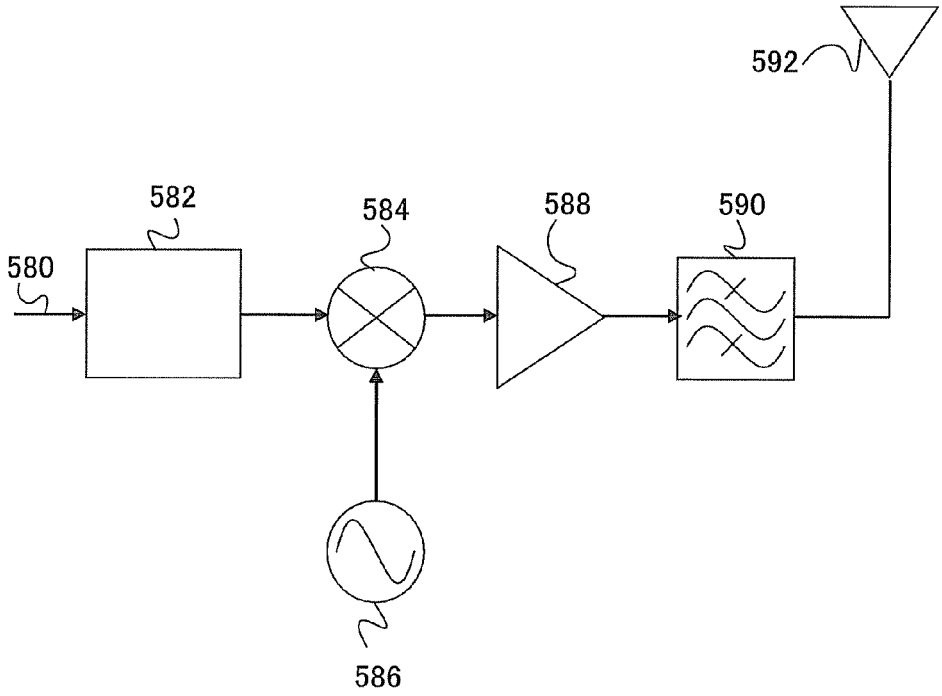
FIG. 13 is a block diagram schematically showing a radio communication device of a fourth embodiment.
Figure 14:
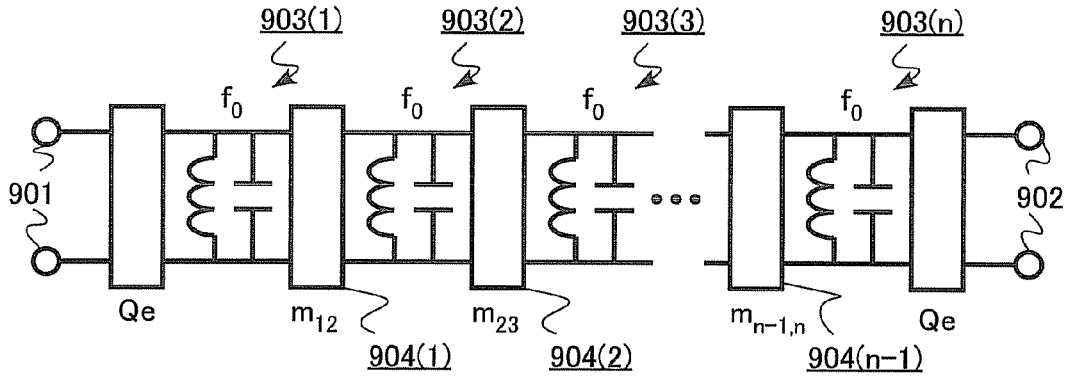
FIG.14 RELATED ART
FIG. 14 is a circuit diagram of a filter circuit of a related art.
Figure 15:
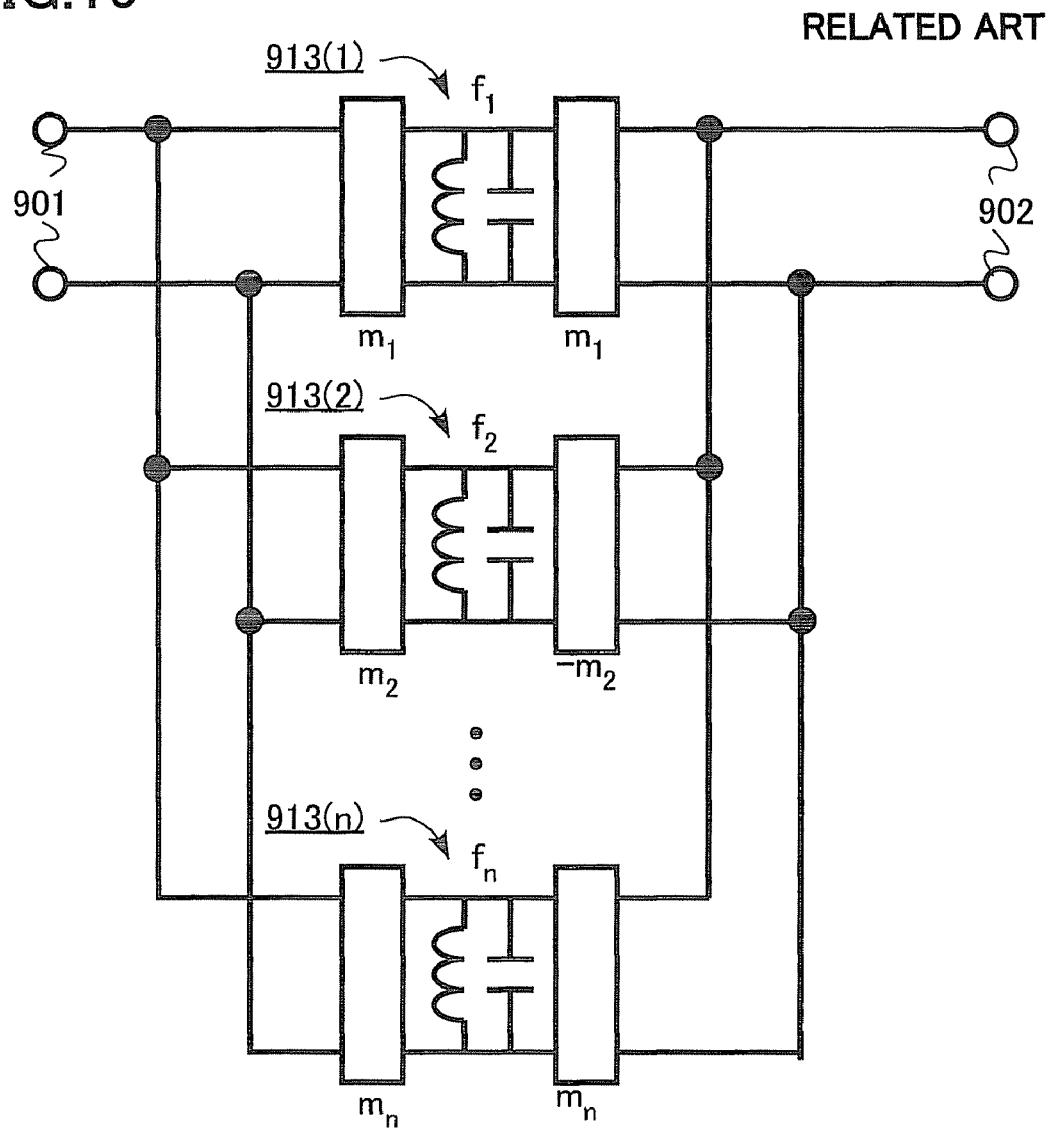
FIG. 15 is a circuit diagram of a filter circuit of another related art.

FIG. 13 is a block diagram schematically showing a radio communication device of a fourth embodiment of the present invention. The radio communication device of the fourth embodiment of the present invention characteristically includes the filter circuit of one of the above described embodiments. Therefore, explanation of the filter circuit is omitted herein.

The radio communication device includes a signal processing circuit 582 that has transmission data 580 input as a signal, a local signal generator 586 that generates a local signal, a frequency converter 584 that performs a frequency conversion by multiplying the transmission signal processed at the signal processing circuit 582 by the local signal, a power amplifier 588 that amplifies the transmission signal subjected to the frequency conversion at the frequency converter 584, a band limiting filter (the filter circuit) 590 that limits the band of the transmission signal amplified by the power amplifier 588, and an antenna 592 through which the transmission signal having the band limited is transmitted.

The transmission data 580 is input to the signal processing circuit 582, and is subjected to transmission processing such as a digital-analog conversion, encoding, and modulation. In this manner, a transmission signal of a baseband or an intermediate frequency (IF) band is generated.

The transmission signal generated at the signal processing circuit 582 is input to the frequency converter (a mixer) 584, and is multiplied by the local signal generated from the local signal generator 586. In this manner, the transmission signal is frequency-converted or "up-converted" to a signal of a radio frequency (RF) band. The RF signal output from the mixer 584 is amplified by the power amplifier (PA) 588, and is then input to the band limiting filter (the transmission filter) 590 formed with the filter circuit of one of the above described embodiments. The transmission filter 590 limits the band of the RF signal amplified by the power amplifier 588, and removes unnecessary frequency components from the amplified RF signal. The RF signal is then released as a radiowave to the air through the antenna 592.

Having the filter circuit that can achieve both sharp bandpass characteristics and high power resistance, the radio communication device of FIG. 13 can have higher power resistance and transmit RF signals of desired characteristics.

The embodiments of the present invention have been described so far, with reference to specific examples. In the above description of the embodiments, explanation of components and the likes that are not relevant to the description of the invention relating to filter circuits and radio communication devices is omitted. However, it is possible to selectively use appropriate components of filter circuits and radio communication devices, if necessary.

Additional advantages and modifications of filter circuits and radio communication devices will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filter circuit comprising:

an input terminal configured to input a signal input having a certain band;

a four-port device configured to receive the signal input from the input terminal at a terminal A, divide and transmit the received signal through terminals B and C, combine signals supplied to the terminals B and C and transmit the combined signal through the terminal A when the signals are in-phase with each other and through a terminal D when the signals are reversed-phase with each other;

an output terminal configured to output the signal transmitted through the terminal D;

a first band stop filter configured to have a center frequency of the input signal within a stopband, reflect the stopband signal and back the signal to the terminal B, and pass a passband signal;

a second band stop filter configured to have the same stopband as the first band stop filter, reflect the stopband signal and back the signal to the terminal C, and pass a passband signal;

a first bandstop resonators circuit having a plurality of resonators configured to reflect signals of a desired band within the passband of the first band stop filter;

a second bandstop resonators circuit having s a plurality of resonators having the same frequency as the first bandstop resonators circuit, configured to reflect signals of a desired band within the passband of the second band stop filter;

a first open end connected in parallel to the first bandstop resonators circuit; and a second open end connected in parallel to the second bandstop resonators circuit, wherein a signal reflected by the first band stop filter and supplied to the terminal B is reversed-phase with a signal reflected by the second band stop filter and supplied to the terminal C, a signal reflected by the first bandstop resonators circuit and supplied to the terminal B is reversed-phase with a signal reflected by the second bandstop resonators circuit and supplied to the terminal C, and a signal reflected by the first open end and supplied to the terminal B is in-phase with a signal reflected by the second open end and supplied to the terminal C.

2. The circuit according to claim 1, wherein an electric length of the first open end with respect to a center frequency of the desired band differs 90 degrees from an electric length of the second open end with respect to a center frequency of the desired band.

3. The circuit according to claim 1, further comprising a 90-degree delay circuit between the first bandstop resonators circuit and the first band stop filter or between the terminal C and the second band stop filter.

4. The circuit according to claim 1, further comprising a phase shifter between the first band stop filter and the first bandstop resonators circuit or between the second band stop filter and the second bandstop resonators circuit.

5. The circuit according to claim 1, wherein the resonators in the first bandstop resonators circuit and the second bandstop resonators circuit are superconductive resonators, and transmission lines in the first bandstop resonators circuit and the second bandstop resonators circuit are superconductive lines.

6. The circuit according to claim 1, wherein the four-port device is a magic T.

7. A filter circuit comprising:

an input terminal configured to input a signal input having a certain band;

a four-port device configured to receive the signal input from the input terminal at a terminal A, divide and transmit the received signal through terminals B and C, combine signals supplied to the terminals B and C and transmits the combined signal through the terminal A when the signals are in-phase with each other and through a terminal D when the signals are reversed-phase with each other;

an output terminal configured to output the signal transmitted through the terminal D;

a first band stop filter configured to have a center frequency of the input signal within a stopband, reflect the stopband signal and back the signal to the terminal B, and passes a passband signal;

a second band stop filter configured to have the same stopband as the first band stop filter, and reflect the stopband signal and back the signal to the terminal C, and passes a passband signal;

a first bandstop resonators circuit having a plurality of resonators configured to reflect signals of a desired band within the passband of the first band stop filter;

a second bandstop resonators circuit having a plurality of resonators having the same frequency as the first bandstop resonators circuit, configured to reflect signals of a desired band within the passband of the second band stop filter;

a first terminal end connected in parallel to the first bandstop resonators circuit; and a second terminal end connected in parallel to the second bandstop resonators circuit, wherein a signal reflected by the first band stop filter and supplied to the terminal B is reversed-phase with a signal reflected by the second band stop filter and supplied to the terminal C, a signal reflected by the first bandstop resonators circuit and supplied to the terminal B is reversed-phase with a signal reflected by the second bandstop resonators circuit and supplied to the terminal C.

8. The circuit according to claim 7, further comprising a 90-degree delay circuit between the terminal B and the first band stop filter or between the terminal C and the second band stop filter.

9. The circuit according to claim 7, further comprising a phase shifter between the first band stop filter and the first bandstop resonators circuit or between the second band stop filter and the second bandstop resonators circuit.

10. The circuit according to claim 7, wherein the resonators in the first bandstop resonators circuit and the second bandstop resonators circuit are superconductive resonators, and transmission lines in the first bandstop resonators circuit and the second bandstop resonators circuit are superconductive lines.

11. The circuit according to claim 7, wherein the four-port device is a magic T.

12. A radio communication device comprising:

a signal processing circuit configured to perform transmission processing on transmission data, to obtain a transmission signal;

a power amplifier configured to amplify the transmission signal;

a filter circuit configured to perform filtering on the amplified transmission signal and includes: an input terminal configured to input a signal input having a certain band; a four-port device configured to receive the signal input from the input terminal at a terminal A, divide and transmit the received signal through terminals B and C, and combine signals supplied to the terminals B and C and transmit the combined signal through the terminal A when the signals are in-phase with each other and through a terminal D when the signals are reversed-phase with respect to each other; an output terminal configured to output the signal transmitted through the terminal D; a first band stop filter configured to have a center frequency of the input signal within a stopband, and reflect the stopband signal at the first bandpass filter and back the signal to the terminal B, and pass a passband signal; a second bandstop filter configured to have the same stopband as the first band stop filter, reflect the stopband signal at the first bandpass filter and back the signal to the terminal C, and pass a passband signal; a first bandstop resonators circuit having a plurality of resonators configured to reflect signals of a desired band within the passband of the first band stop filter; a second bandstop resonators circuit having a plurality of resonators having the same frequency as the first bandstop resonators circuit, configured to reflect signals of a desired band within the passband of the second band stop filter; a first open end connected in parallel to the first bandstop resonators circuit; and a second open end connected in parallel to the second bandstop resonators circuit, wherein a signal reflected by the first band stop filter and supplied to the terminal B is reversed-phase with a signal reflected by the second band stop filter and supplied to the terminal C, a signal reflected by the first bandstop resonators circuit and supplied to the terminal B is reversed-phase with respect to a signal reflected by the second bandstop resonators circuit and supplied to the terminal C, and a signal reflected by the first open end and supplied to the terminal B is in phase with a signal reflected by the second open end and supplied to the terminal C; and an antenna configured to release the signal obtained as a radiowave from the filter circuit to the air.

13. The device according to claim 12, wherein an electric length of the first open end with respect to a center frequency of the desired band differs 90 degrees from an electric length of the second open end with respect to a center frequency of the desired band.

14. The device according to claim 12, wherein the filter circuit further includes a 90-degree delay circuit between the terminal B and the first band stop filter or between the terminal C and the second band stop filter.

15. The device according to claim 12, wherein the filter circuit further includes a phase shifter between the first band stop filter and the first bandstop resonators circuit or between the second band stop filter and the second bandstop resonators circuit.

16. The device according to claim 12, wherein the resonators in the first bandstop resonators circuit and the second bandstop resonators circuit are superconductive resonators, and transmission lines in the first bandstop resonators circuit and the second bandstop resonators circuit are superconductive lines.

17. A radio communication device comprising:

a signal processing circuit configured to perform transmission processing on transmission data, to obtain a transmission signal;

a power amplifier configured to amplify the transmission signal;

a filter circuit configured to perform filtering on the amplified transmission signal and includes: an input terminal configured to input a signal input having a certain band; a four-port device configured to receive the signal input from the input terminal at a terminal A, divide and transmit the received signal through terminals B and C, and combine signals supplied to the terminals B and C and transmit the combined signal through the terminal A when the signals are in-phase with each other and through a terminal D when the signals are reversed-phase with each other; an output terminal configured to output the signal transmitted through the terminal D; a first band stop filter configured to have a center frequency of the input signal within a stopband, reflect the stopband signal at the first bandpass filter and back the signal to the terminal B, and pass a passband signal; a second band stop filter configured to have the same stopband as the first band stop filter, reflect the stopband signal at the first bandpass filter and back the signal to the terminal C, and pass a passband signal; a first bandstop resonators circuit having a plurality of resonators configured to reflect signals of a desired band within the passband of the first band stop filter; a second bandstop resonators circuit having a plurality of resonators having the same frequency as the first bandstop resonators circuit, configured to reflect signals of a desired band within the passband of the second band stop filter; a first terminal end connected in parallel to the first bandstop resonators circuit; and a second terminal end connected in parallel to the second resonators circuit, wherein a signal reflected by the first band stop filter and supplied to the terminal B is reversed-phase with a signal reflected by the second band stop filter and supplied to the terminal C, and a signal reflected by the first bandstop resonators circuit and supplied to the terminal B is reversed-phase with a signal reflected by the second bandstop resonators circuit and supplied to the terminal C; and an antenna configured to release the signal obtained as a radiowave from the filter circuit to the air.

18. The device according to claim 17, wherein the filter circuit further includes a 90-degree delay circuit between the terminal B and the first band stop filter or between the terminal C and the second band stop filter.

19. The device according to claim 17, wherein the filter circuit further includes a phase shifter between the first band stop filter and the first bandstop resonators circuit or between the second band stop filter and the second bandstop resonators circuit.

20. The device according to claim 17, wherein the resonators in the first bandstop resonators circuit and the second bandstop resonators circuit are superconductive resonators, and transmission lines in the first bandstop resonators circuit and the second bandstop resonators circuit are superconductive lines.

* * * * *